US006029303A

United States Patent [19]

Dewan

[11] Patent Number: 6,029,303

[45] Date of Patent: Feb. 29, 2000

[54] ELECTRONIC TOOTHBRUSH

[76] Inventor: Raman N. Dewan, 4016 Sierra Dr., Austin, Tex. 78731

[21] Appl. No.: 09/034,634

[22] Filed: Mar. 4, 1998

[51] Int. Cl.[7] ..... A46B 9/04

[52] U.S. Cl. ..... 15/105; 15/167.1

[58] Field of Search ..... 15/105, 167.1, 15/176.1

[56] References Cited

U.S. PATENT DOCUMENTS

| | | | |
|---|---|---|---|
| 4,788,734 | 12/1988 | Bauer | 15/105 |
| 4,866,807 | 9/1989 | Kreit et al. | 15/167.1 |
| 5,331,707 | 7/1994 | Irizarry | 15/167.1 |
| 5,438,726 | 8/1995 | Leite | 15/105 |
| 5,561,881 | 10/1996 | Klinger et al. | 15/105 |
| 5,572,762 | 11/1996 | Scheiner | 15/105 |
| 5,704,087 | 1/1998 | Strub | 15/105 |
| 5,784,742 | 7/1998 | Giuliani et al. | 15/167.1 |

FOREIGN PATENT DOCUMENTS

| | | | |
|---|---|---|---|
| 2918806 | 11/1980 | Germany | 15/167.1 |
| 2236071 | 3/1991 | United Kingdom | 15/167.1 |
| 2252234 | 5/1992 | United Kingdom | 15/105 |

*Primary Examiner*—Terrence R. Till

*Attorney, Agent, or Firm*—Joseph Lally; Dewan & Lally, L.L.P.

[57] ABSTRACT

A toothbrush including an elongated handle, a bristle head, a plurality of bristles, and an electronic device. The elongated handle includes a recess suitable for housing an electronic device. The bristle head is connected to the elongated handle. The plurality of bristles are embedded in the bristle head. The electronic device is configured to produce a detectable output sequence after a condition has been satisfied. In one embodiment, the detectable output comprises an audio signal while in an alternative embodiment, the detectable output comprises a visual signal such as light. In one embodiment, the electronic device includes a sequence initiator, a timer, and an output device all coupled to a control unit. The control unit is preferably adapted to initiate the timer upon receiving an initiation signal from the sequence initiator. The control unit is further configured to receive a signal from the timer after a minimum specified duration has expired. The control unit, upon receiving the signal from the timer, is preferably configured to enable the output device to produce a desired output signal.

5 Claims, 2 Drawing Sheets

ELECTRONIC TOOTHBRUSH

BACKGROUND OF THE INVENTION

1. Field of the Invention

The present invention relates to the field of dental care and more particularly to an improved toothbrush into which an electronic device is integrated for indicating to the user of the toothbrush and others when a certain brushing condition has been satisfied.

2. Description of the Relevant Art

In the field of dental care, a wide variety of improvements to the common toothbrush have been made typically to improve the efficiency with which the user can brush his or her teeth. The long term benefits provided by consistent and regular brushing of the teeth are well-established. The many improvements to the toothbrush are intended to improve the benefits provided by brushing, typically by facilitating a more complete and thorough cleaning of the teeth through various ergonomic and other related improvements designed to make it easier for the user of the toothbrush to achieve a complete brushing. While the existing toothbrush improvements are beneficial, however, these benefits are substantially wasted if the toothbrush is not used properly and replaced at periodic intervals.

The effectiveness of any toothbrush depends on several factors including, for example, the frequency and regularity with which the toothbrush is used, the amount of time or thoroughness of each brushing, and the frequency with which the user replaces a toothbrush with a new one. The benefits provided by any particular toothbrush diminish over time as the bristles become used and are no longer able to adequately provide the necessary cleaning and massaging of the teeth and gumline. In addition, the effectiveness of any toothbrush depends upon the amount of time spent brushing. If, for example, a particular user has a tendency toward brushing for an inadequately short period of time, the user may not receive the benefit provided by a more regular and thorough brushing.

Among the group of users who might be expected to tend towards brushing their teeth for an undesirably short duration are children. Parents will readily appreciate that long term dental care is not typically uppermost in the mind of their children as they brush their teeth. In many cases, children must be reminded repeatedly and consistently to brush their teeth and to take an adequate amount of time in doing so. It will be further appreciated that children (and others) are often motivated to complete an undesirable task by the prospect of obtaining a particular reward upon completion of the task. It would therefore be useful to provide a toothbrush which actually encouraged users to brush their teeth for a minimum duration by, for example, providing them with a reward for doing so.

In addition, it is common among users of all ages to retain a particular toothbrush for longer than a useful lifetime of the particular toothbrush. Most organizations related to the field of dentistry, including the American Dental Association, recommend regularly replacing a used toothbrush with a new toothbrush to maximize the benefits provided by brushing and to ensure adequate massaging of the gumlines during each brushing. Unfortunately, however, it will be appreciated that many users frequently forget to regularly replace an existing toothbrush with a new toothbrush.

While the existing toothbrush improvements are beneficial, they are not directed at the goal of prompting or encouraging users to brush their teeth for a predetermined duration or to replace their toothbrushes at specified intervals. Therefore, it would be beneficial to provide a toothbrush that actually notified the toothbrush user when his or her teeth have been brushed for the proper amount of time and that further reminded the toothbrush user when a useful lifetime of the existing toothbrush has been exceeded. It would be further beneficial if the toothbrush providing these benefits was economical, readily manufacturable, and simple to use.

SUMMARY OF THE INVENTION

The problems identified above are in large part addressed by an improved toothbrush into which an electronic device is incorporated to inform the user when a specified condition related to the brushing of the teeth has been satisfied. By incorporation an electronic device into a toothbrush, an automated means of informing the user when, for example, a minimum brushing duration has been exceeded or when a useful lifetime of a toothbrush has been exceeded is provided. These improvements might encourage children and others to brush their teeth for a minimum duration by providing them with a reward in the form of an audio or visual output sequence upon satisfying a predetermined brushing condition.

Broadly speaking, it is an object of the present invention to provide a toothbrush comprised of an elongated handle and a bristle head connected to the elongated handle. The toothbrush includes a recess suitable for housing an electronic device, preferably located within the elongated handle. The bristle head includes a plurality of bristles embedded within the bristle head. The improved toothbrush includes an electronic device within the recess. The electronic device is configured to produce a detectable output sequence after a condition has been satisfied thereby providing notification to the user of the toothbrush that the condition has been satisfied. In one embodiment, the detectable output sequence comprises an audio signal such as a series of musical notes designed to entertain a child. In an alternative embodiment, the detectable output sequence may comprise a visual signal such as the light produced by a flashing LED.

In one embodiment, the electronic device includes a sequence initiator, a timer, and an output device coupled to a control unit. The control unit is adapted to initiate the timer upon receiving an initiation signal from the initiator. The timer is configured to produce and the control unit is configured to receive a signal after a predetermined duration has expired. In one embodiment, the sequence initiator includes a motion detector configured to produce the initiation signal automatically when the toothbrush is in motion. In one embodiment, the sequence initiator is simply comprised of a push button designed to activate a switch thereby generating the initiation signal upon depressing the push button. In one embodiment, the timer circuit includes a preset register for storing a value indicative of the minimum duration. Preferably, this preset register is programmable and the control unit is adapted to store a predetermined value in the preset register. The preferred embodiment may further include a battery coupled to the electronic device. In one embodiment, the bristle head is detachable from the elongated handle. In this embodiment, the bristle head may be suitably replaced without replacing the electronic device. In an embodiment in which the battery is housed within the bristle head, the battery is replaced simultaneously with the bristle head.

It is still further an object of the present invention to provide an improved toothbrush including an elongated handle, a bristle head connected to the elongated handle, and a plurality of bristles embedded in the bristle head. The toothbrush includes a recess, preferably within the elongated handle, an electronic device within the recess, and a battery housed within a battery housing of the toothbrush and connected to the electronic device. The electronic device is configured to produce an output sequence after a predetermined condition has been satisfied. In one embodiment, the electronic device includes a timer configured to produce a cumulative interval signal after a predetermined cumulative time elapses from a first initiation of the timer. In this embodiment, the control unit is preferably adapted to receive the cumulative interval signal and to initiate an output sequence in response thereto, thereby indicating to the user that the predetermined cumulative time has elapsed. In still another embodiment, the battery is designed with a current delivering capacity calibrated with respect to the power consumption of the electronic device and associated circuitry, such that the available power of the battery is consumed after the predetermined cumulative duration.

BRIEF DESCRIPTION OF THE DRAWINGS

Other objects and advantages of the invention will become apparent upon reading the following detailed description and upon reference to the accompanying drawings in which.

Figure 1:
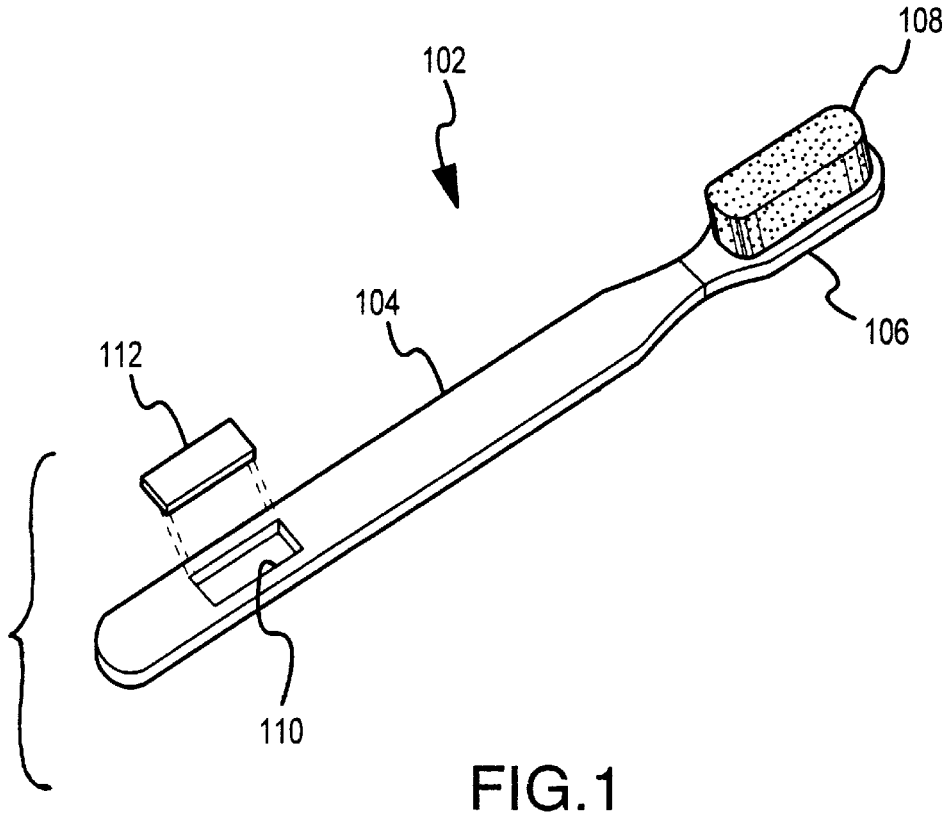
FIG. 1 is a prospective view of an improved toothbrush including an elongated handle connected to a bristle head wherein the elongated handle includes a recess suitable for receiving the electronic device shown.

While the invention is susceptible to various modifications and alternative forms, specific embodiments thereof are shown by way of example in the drawings and will herein be described in detail. It should be understood, however, that the drawings and detailed description presented herein are not intended to limit the invention to the particular embodiment disclosed, but on the contrary, the intention is to cover all modifications, equivalents, and alternatives falling within the spirit and scope of the present invention as defined by the appended claims.

DETAILED DESCRIPTION OF THE INVENTION

Turning now to the drawings, FIG. 1 shows a prospective view of an improved toothbrush 102. Toothbrush 102 includes an elongated handle 104 attached to a bristle head 106. Bristle head 106 includes a plurality of bristles 108 embedded into bristle head 106 and extending away from the bristle head in a familiar fashion. Elongated handle and bristle head 106 may be fabricated from a variety of durable plastics or other suitable materials designed for economy and durability. Although the elongated handle 104 of FIG. 1 is shown as substantially straight, it will be appreciated that bristle head 106 may be oriented at an angle with respect to elongated handle 104 and that elongated handle 104 itself may include one or more angles designed to produce an ergonomically efficient toothbrush 102 for comfort, ease of use, and facilitating access to all regions of the user's mouth. Toothbrush 102 defines a recess 110, preferably located within elongated handle 104, and adapted to receive an electronic device 112. The electronic device 112 is preferably configured to produce a detectable output sequence after a predetermined condition, typically related to the use of the toothbrush, has been satisfied. In this manner, toothbrush 102 notifies the user when a predetermined condition has been satisfied.

In one embodiment of the present invention, the detectable output sequence produced by the electronic device may comprise an audio signal. In an embodiment designed to encourage children and other users of toothbrush 102 to brush their teeth for a minimum duration, the output sequence produced by electronic device 112 may comprise a series of musical notes such as a child's tune whereby the user of the toothbrush is rewarded for satisfying a brushing condition by hearing a musical tune played. In an alternative embodiment, the output sequence may comprise a vocal sequence such as a complimentary or encouraging phrase, possibly spoken by a person or fictional character familiar to the user of the toothbrush. In still another alternative embodiment, the detectable output sequence produced by electronic device 112 may comprise a visually detectable output in the form of, for example, light produced by an LED (not shown) integrated into or connected to the toothbrush 102.

Figure 2:
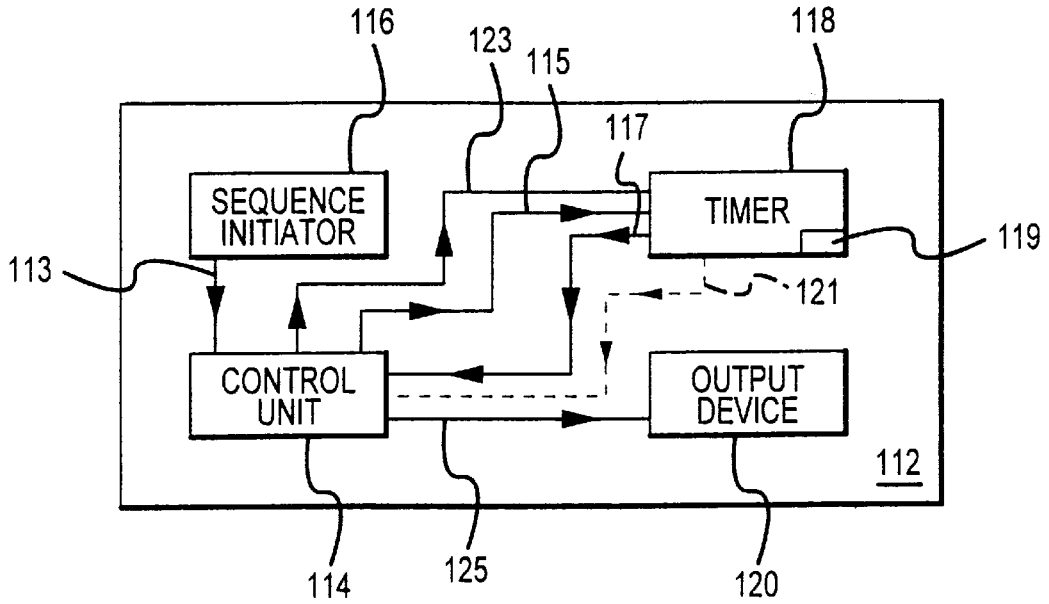
FIG. 2 is a block diagram of an embodiment of the electronic device of FIG. 1.

Turning now to FIG. 2, a block diagram of one embodiment of electronic device 112 is shown. In this embodiment, electronic device 112 includes a control unit 114 coupled to a sequence initiator 116, a timer 118, and an output device 120. The sequence initiator 116 is designed to produce an initiation signal 113 to control unit 114. In one embodiment, sequence initiator 116 may comprise a motion detector whereby the sequence initiation signal is provided automatically whenever the user starts brushing his or her teeth. A suitable motion detector may be comprised of, for example, a commercially available mercury-free motion switch wherein the switch is designed to be either normally open or normally closed and may further include a variety of damping mechanisms including an embodiment in which the switch is un-damped, air damped, or fluid damped. In one embodiment, the motion detector may be of a one-shot variety such that the timer sequence is initiated upon detecting an initial movement of the toothbrush. In another embodiment, it may be useful to provide continuous monitoring of the movement of the toothbrush such that the user cannot obtain the detectable output sequence unless the toothbrush is kept in adequate motion for a predetermined duration. For example, the motion detector may include a switch that is closed only when the toothbrush is kept in continuous motion such that the timer increments (or decrements) only when toothbrush is actually moving. Such an embodiment may provide a mechanism for monitoring the actual brushing time. Suitable motion and disturbance detectors are commercially available from, among others, Aerodyne Controls Corporation in Ronkonkoma, N.Y.

Figure 4:
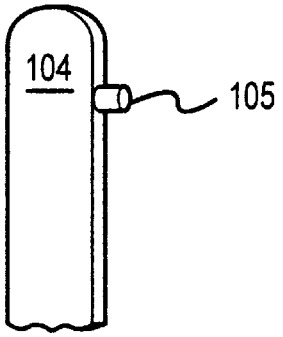
FIG. 4 is a partial view of the elongated handle including a push button design to initiate the timer.

In other embodiments, the motion detector may comprise a mercury-type switch in which a flowable conducting material connects the two ends of an otherwise open circuit when the toothbrush is oriented in a particular direction such as by tilting the toothbrush. Such switches are commercially available and common in, for example, the temperature control units found in many homes. Ideally, the flowable material used in such an embodiment is consistent with the use of the present invention as a toothbrush designed to be used in close proximity to a person's mouth. Accordingly, suitable non-toxic and non-hazardous materials are preferred in the switch. In an alternative embodiment, sequence initiator 116 may simply comprise a push button designed to produce the initiation signal to control unit 114 when the push button is depressed. FIG. 4 shows such an embodiment, including a push button 105 located towards an end of elongated handle 104. The push button embodiment of the sequence initiator 116 might result in a simpler and more economical method of initiating the sequence.

The timer circuit 118 includes any variety of commercially available digital electronic timer circuits. In one embodiment, timer circuit 118 may include a register 119 wherein the register value is indicative of the duration that is monitored by timer circuit 118. In one embodiment, register 119 is programmable such that control unit 114 may preset the duration required. In alternative embodiments, the preset of such a register may occur prior to or subsequent to purchase by the consumer. In one embodiment, the timer circuit is designed to monitor, in conjunction with the sequence initiator 116, a minimum brushing duration. In this embodiment, the control unit 114 sends a signal 115 to timer circuit 118 upon receiving an initiation sequence from sequence initiator 116. Upon receiving the appropriate signal 115 from control unit 114, timer circuit 118 begins to monitor or otherwise record the duration of time that has elapsed since the sequence initiator 116 produced the initiation signal 113 to control unit 114. A suitable mechanism for recording this duration may simply comprise a countdown circuit in which the timer circuit 116 counts down a number of clock cycles. A suitable countdown circuit, familiar to those in the field of digital electronics, requires timer 118 to include a presetable register value and associated circuitry in which the register value is decremented each clock cycle until a zero value is produced whereby the timer circuit returns a signal 117 to the control unit indicating that the specified number of clock cycles has elapsed. In this manner, the minimum duration may be adjusted by changing the value stored in register 119 thereby adjusting the number of clock cycles counted by the timer circuit 118.

Figure 5:
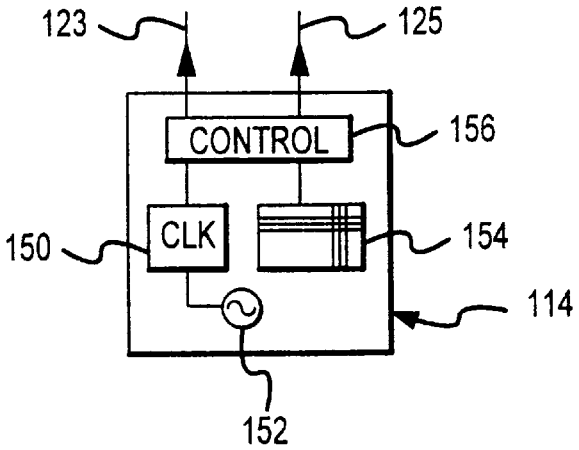
FIG. 5 is a block diagram depicting select feature of the control unit of FIG. 2.

Turning momentarily to FIG. 5, a block diagram depicting selected features of control unit 114 is presented. Preferably, control unit 114 includes storage means such as the memory array 154 and a clock circuit 150. Clock circuit 150 is configured to receive an oscillating signal from oscillator 152 and to produce a digital clock signal that is passed to control logic 156 and routed to timer 118 as clock signal 123. In addition, control logic 156 is coupled to memory array 154 and configured to route an output sequence over bus 125 to output device 120 (shown in FIG. 2) upon receiving the appropriate signal 117 from timer 118.

In one embodiment useful for monitoring the cumulative lifetime of bristles 108, timer circuit 118 is further configured to produce a cumulative interval signal 121 after a predetermined cumulative time has elapsed from a first initiation of the timer. Such a cumulative interval signal 121 may be produced, in one embodiment, by including a cumulative register (not shown in the drawings) within timer circuit 118. The cumulative register may be designed to decrement from a predetermined value without resetting. In this manner, the useful lifetime of the toothbrush may be monitored. Thus, control unit 114 may be configured to reset a first register within timer 118 upon each initiation signal 113 received from sequence initiator 116 for monitoring a minimum duration of each brushing, but timer circuit 118 may include a register that is not preset upon each new initiation by sequence initiator 116 such that the cumulative lifetime of the toothbrush is monitored. One embodiment of the present invention contemplates a control unit 114 adapted to produce a first output sequence each time a minimum brushing duration has been exceeded and a second output sequence when the useful lifetime has been exceeded.

Upon receiving an appropriate signal from timer circuit 118, control unit 114 is preferably adapted to produce a detectable output sequence on output device 120. In one embodiment, output device 120 may comprise a miniaturized speaker suitable for use with a low power DC circuit contemplated by control unit 114. In this embodiment, the audio signal produced by control unit 114 may be in the form of a musical sequence such as a series of notes from a song familiar to children, a vocal sequence such as one or more words, or other suitable audio sequence designed to inform the user of the toothbrush when a minimum brushing duration has been exceeded. Preferably, the output sequence produced by control unit 114 and output device 120 generate an incentive for the user of the toothbrush to continue brushing his or her teeth for the minimum duration in order to receive the output sequence. Applying this concept to children, the output sequence may comprise a song familiar to children, a vocal sequence spoken by a person or fictional character familiar to children, or other suitable output sequence generally pleasing to children. Preferably, the control unit 114 includes appropriate storage means including, in one embodiment, non-volatile memory cells into which a digitally encoded audio sequence is stored. In one embodiment, a plurality of electronic devices 112 may each include a different encoded audio sequence such that the particular audio sequence produced to the user may be changed on a regular basis by replacing electronic device 112 with a different electronic device 112 that plays a different audio sequence to keep the user motivated to obtain the sequence. In addition, each individual electronic device 112 may include a plurality of encoded output sequences such that the detectable output sequence may vary from use to use without replacing device 112. It will appreciated that this embodiment might be useful in further motivating the toothbrush user to satisfy the appropriate brushing condition.

In an alternative embodiment, output device 120 may comprise an LED or other suitable means for producing a visually detectable sequence upon receiving an appropriate signal from control unit 114. A visual signal may be a more economical approach in some embodiments of the present invention. In addition, a visual signal is more suitable for an application in which the user may be hearing impaired. The LED may be suitably integrated into the electronic device 112 or incorporated into other regions of the toothbrush 102 and connected to electronic device 112 through wires embedded within toothbrush 102.

Figure 3:
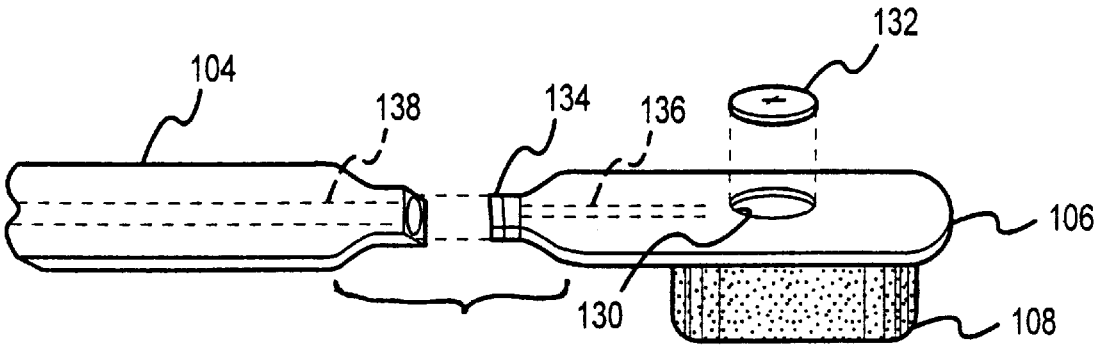
FIG. 3 is an exploded view of one embodiment of the improved toothbrush in which the bristle head is replaceably detachable from the bristle head and wherein the bristle head is adapted to receive a battery.

Turning now to FIG. 3, an embodiment of the present invention is depicted in which the bristle head 106 is detachable from the elongated handle 104. In the embodiment shown in FIG. 3, bristle head 106 further includes a battery housing 130 adapted to receive a power source such as a battery 132. By providing for a detachable bristle head 106, the present invention contemplates the ability to replace bristle head 106 when the useful lifetime of the bristles 108 has been exceeded. This useful lifetime of the bristles 108 may be monitored by the timer circuit 118 as described previously. In an alternative embodiment, the useful lifetime of bristles 108 may be monitored by providing for a battery 132 calibrated in conjunction with the circuitry associated with control unit 114 and output device 120 whereby the useful charge within battery 132 is substantially consumed after the useful lifetime of bristles 108. Thus, in this embodiment, the useful lifetime of the bristles 108 is detected by the user when the toothbrush 102 fails to produce the desired output sequence. In an embodiment in which the output sequence is designed to motivate the user to satisfy a minimum brushing duration, the user is thereby additionally motivated to replace the bristle head 106 after the useful lifetime of battery 132 has expired if he or she desires to continue to receive the output sequence. By providing for a detachable bristle head 106, it is contemplated that the bristle head 106 may be economically replaced while retaining the potentially more expensive elongated handle including the electronic device 112. In this embodiment, bristle head 106 may be attached to elongated handle 104 by means of a threaded screw 134 or other suitable attaching means. The power provided by battery 132 is supplied to electronic device 112 by means of a pair of wires 136 within bristle head 106 designed to connect to a corresponding pair of wires 138 within elongated handle 104 when bristle head 106 is connected to elongated handle 104. Although the embodiment depicted in FIG. 3 shows the battery 132 and battery housing 130 within the bristle head 106, it will be appreciated that these elements may be suitably arranged or placed within elongated handle 104. Similarly, recess 110 and electronic device 112, although depicted within elongated handle 104 in FIG. 1, may suitably be located within bristle head 106.

It will be appreciated to those skilled in the art that the present invention contemplates an improved toothbrush for providing a notification to a user of the toothbrush whenever a predetermined condition has been satisfied. It is understood that the form of the invention shown and described in the detailed description and the drawings are to be taken merely as presently preferred examples. It is intended that the following claims be interpreted broadly to embrace all the variations of the preferred embodiments disclosed.

What is claimed is:

1. A toothbrush comprising:

an elongated handle;

a bristle head connected to said elongated handle;

a plurality of bristles embedded in said bristle head;

an electronic device located within a recess of said toothbrush, wherein said electronic device is configured to produce a detectable output sequence after a condition has been satisfied to notify a user of said toothbrush of the satisfaction of said condition;

wherein said condition comprises a predetermined duration and wherein said electronic device comprises a sequence initiator, a timer, and an output device all coupled to a control unit, wherein said control unit is adapted to initiate said timer upon receiving an initiation signal from said initiator, and wherein said control unit is further configured to receive a signal from said timer circuit after said minimum duration has been satisfied, and still further wherein said control unit enables said output device to produce said detectable output sequence; and wherein said sequence initiator comprises a motion detector configured to produce said initiation signal when said toothbrush is in motion.

2. A toothbrush comprising:

an elongated handle;

a bristle head connected to said elongated handle;

a plurality of bristles embedded in said bristle head;

an electronic device located within a recess of said toothbrush, wherein said electronic device is configured to produce a detectable output sequence after a predetermined duration has expired to notify a user of said toothbrush of the expiration of said duration;

wherein said electronic device comprises a sequence initiator, a timer, and an output device all coupled to a control unit adapted to initiate said timer upon receiving an initiation signal from said initiator, said control unit being configured to receive a signal from said timer circuit after said minimum duration has been satisfied, and still further configured to enable said output device to produce said detectable output sequence; and wherein said control unit includes control logic coupled to a memory array and a clock circuit including an oscillator, wherein said clock circuit is configured to produce a clock signal.

3. A toothbrush comprising:

an elongated handle;

a bristle head connected to said elongated handle wherein said bristle head is detachable from said elongated handle;

a plurality of bristles embedded in said bristle head;

an electronic device located within a recess of said toothbrush, wherein said electronic device is configured to produce a detectable output sequence after a condition has been satisfied to notify a user of said toothbrush of the satisfaction of said condition; and a battery housing within said bristle head suitable for connecting a battery to said electronic device when said battery is received within said battery housing.

4. An electronic device suitable for placement within a recess of a toothbrush, said electronic device comprising a sequence initiator adapted to produce an initiation signal, a timer, an output device, and a control unit, wherein said control unit is configured to receive said initiation signal and initiate said timer in response thereto and further wherein said timer is configured to produce a signal when a specified duration has elapsed from the initiation of said timer, and further wherein said output device is configured to receive said signal from said timer and produce a detectable output sequence on said output device in response thereto and, wherein said sequence initiator comprises a motion detector and wherein said sequence initiator produces said initiation signal upon detecting motion of said electronic device.

5. An electronic device suitable for placement within a recess of a toothbrush, said electronic device comprising a sequence initiator adapted to produce an initiation signal, a timer, an output device, and a control unit, wherein said control unit is configured to receive said initiation signal and initiate said timer in response thereto and further wherein said timer is configured to produce a signal when a specified duration has elapsed from the initiation of said timer, and further wherein said output device is configured to receive said signal from said timer and produce a detectable output sequence on said output device in response thereto and wherein said control unit includes a memory array configured with information suitable for producing an audio sequence and wherein said output device comprises a audio device suitable for playing said audio sequence.

* * * * *